US007004330B1

(12) United States Patent
Tew et al.

(10) Patent No.: US 7,004,330 B1
(45) Date of Patent: Feb. 28, 2006

(54) METHODS AND APPARATUS FOR WATERMELON SIZING, COUNTING AND SORTING

(75) Inventors: Anthony Tew, Yuma, AZ (US); Seth A. Hollyman, Yuma, AZ (US); Richard A. McGaw, Yuma, AZ (US); Timothy Colin, Woodland, CA (US)

(73) Assignee: Timco Distributors, Inc., Woodland, CA (US)

( * ) Notice: Subject to any disclaimer, the term of this patent is extended or adjusted under 35 U.S.C. 154(b) by 148 days.

(21) Appl. No.: 10/162,775

(22) Filed: Jun. 4, 2002

Related U.S. Application Data

(60) Provisional application No. 60/330,062, filed on Oct. 15, 2001.

(51) Int. Cl.
*B07C 5/16* (2006.01)

(52) U.S. Cl. ..... 209/592; 209/645; 209/651

(58) Field of Classification Search ..... 209/592, 209/596, 645, 651; 198/959; 177/50, 25.11, 177/25.19; 702/101, 102, 173, 174
See application file for complete search history.

(56) References Cited

U.S. PATENT DOCUMENTS

| | | | | | |
|---|---|---|---|---|---|
| 3,627,127 | A | * | 12/1971 | Whiteford | 209/566 |
| 3,857,488 | A | * | 12/1974 | Le Cren | 209/593 |
| 4,413,739 | A | * | 11/1983 | Kohashi | 209/593 |
| 4,586,613 | A | * | 5/1986 | Horii | 209/556 |
| 4,709,770 | A | * | 12/1987 | Kohashi et al. | 177/50 |
| 6,580,038 | B1 | * | 6/2003 | Mooney | 177/145 |
| 2003/0094404 | A1 | * | 5/2003 | Kvisgaard et al. | 209/645 |

* cited by examiner

*Primary Examiner*—Donald P. Walsh
*Assistant Examiner*—Joseph C. Rodriguez
(74) *Attorney, Agent, or Firm*—H. Michael Brucker

(57) ABSTRACT

Methods and apparatus for sizing watermelons by weight in which a conveyor belt carries watermelons from a loading station to a weigh station and finally to a discharge station where they are directed to one of several bins depending on their weight.

19 Claims, 5 Drawing Sheets

METHODS AND APPARATUS FOR WATERMELON SIZING, COUNTING AND SORTING

This application claims the benefit of provisional application 60/330,062, filed Oct. 15, 2001.

The present invention relates to methods and apparatus for sizing and sorting objects and, in particular, to methods and apparatus for sizing, counting and sorting watermelons and similar items.

BACKGROUND OF THE INVENTION

Modern commercial distribution and retailing of watermelons more and more requires that the watermelons be accurately sized—by weight—before shipment to retail outlets where they are offered to consumers. Attempts to size watermelons manually have been unsuccessful, both in terms of accuracy and cost-effectiveness. Prior attempts to mechanize the process have also been unsuccessful due to a lack of accuracy and reliability.

BRIEF DESCRIPTION OF THE INVENTION

The present invention is a conveyor system in which watermelons are loaded at a loading station at one end of a conveyor belt, delivered to a weighing station and then directed to a discharge station that includes a plurality of collecting bins, each designated to receive watermelons within a specified weight range. The watermelons are transferred off of the conveyor belt into a collecting bin by pushing devices that are adjacent each bin on the opposite side of the conveyor belt. From the time a watermelon is loaded onto the conveyor belt until it is pushed off the conveyor belt into a collecting bin, it remains at the same location on the conveyor belt traveling at a constant speed.

A computer monitors and controls certain functions of the system, including the weighing process which achieves the required accuracy by accounting for the effects of adjacent watermelons on the weighing process. In addition, the computer keeps count of the number and weight of watermelons processed and, using that information, determines to which of the several collecting bins a watermelon is to be directed. The invention is described with reference to watermelons, although it will be obvious to those skilled in the art that the invention is useful with other objects such as cantaloupe and the like.

After a watermelon is loaded onto the conveyor belt, it is carried over a weigh station that underlies the conveyor belt. At the weigh station, a count signal is generated and transmitted to a computer signifying that a watermelon has passed the weigh station. In this way, the computer is able to count the watermelons and know where a watermelon is on the conveyor belt thereafter (based on the conveyor moving at a constant known speed).

A scale which forms part of the weigh station is activated by passing watermelons and generates a weight data signal proportional to the weight of the watermelon. This weight data signal is transmitted to a computer where it is stored. The weight data signal is influenced by other watermelons on the conveyor within a specified distance from the watermelon weighed. Thus, to get the true weight of a watermelon, the weight data signal must be corrected by taking into account the weight data signal from other watermelons on the conveyor belt. Once the corrected weight of a watermelon is calculated, the computer generates a signal that activates a pushing device that directs the watermelon into one of the several collecting bins designated to receive watermelons of that weight.

When the conveyor belt carries the watermelon to the determined collecting bin, the watermelon is pushed off of the belt into that bin. Before each run of watermelons, the computer is programmed to assign a weight range for each of the several collecting bins. Using the method of the present invention, it is possible to calculate the weight of each watermelon to an accuracy of±one-half pound. Thus, filling an order for watermelons of not less than 14 pounds and not more than 15 pounds can be readily achieved.

In addition to accurately calculating the weight of the objects, the present invention also provides a mechanism for moving the objects from the loading station, over the weigh station and to the discharge station and the collecting bins without damage to the objects and without having to transfer the objects off of the conveyor belt before discharging them into a collecting bin. The invention transports the objects without changing their location on the conveyor belt which assures that they will end up in the correct collecting bin.

Accordingly, it is an object of the present invention to provide methods and apparatus for mechanically sizing, sorting and counting watermelons.

It is another object of the present invention to provide a conveyor system for mechanically transporting watermelons to selected bins according to their weight.

Yet another object of the present invention is to weigh watermelons while they are moving on a conveyor belt.

Still another object of the present invention is to increase the accuracy of the weighing process by also taking into account the weight of other watermelons on the conveyor belt.

These and other objects, aspects and features of the present invention will be better understood from the following detailed description of the preferred embodiments when read in conjunction with the appended drawing figures.

DETAILED DESCRIPTION OF THE PREFERRED EMBODIMENTS

Figure 1:
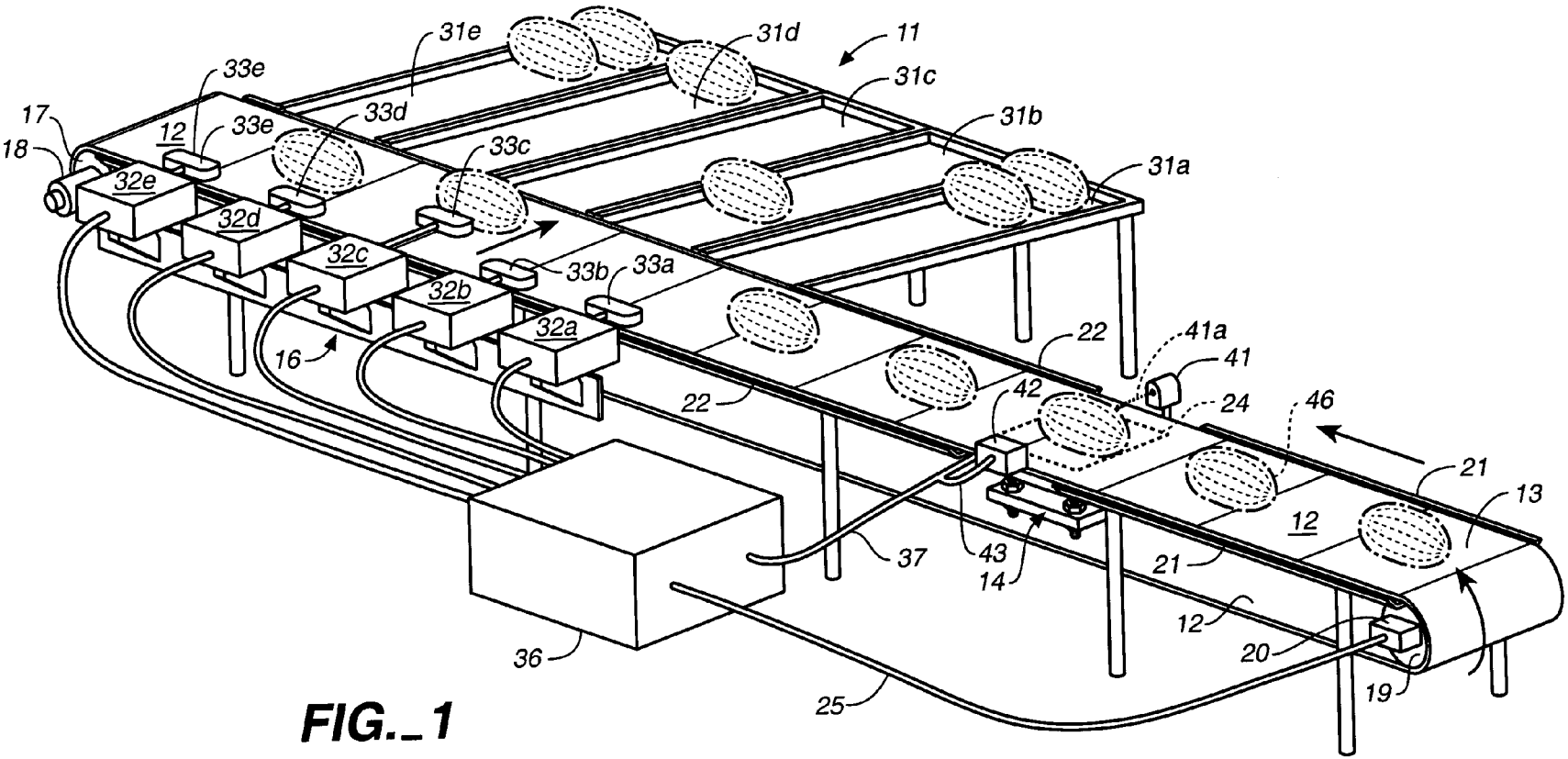
FIG. 1 is a schematic perspective view of the conveyor system of the present invention.
Figure 2:
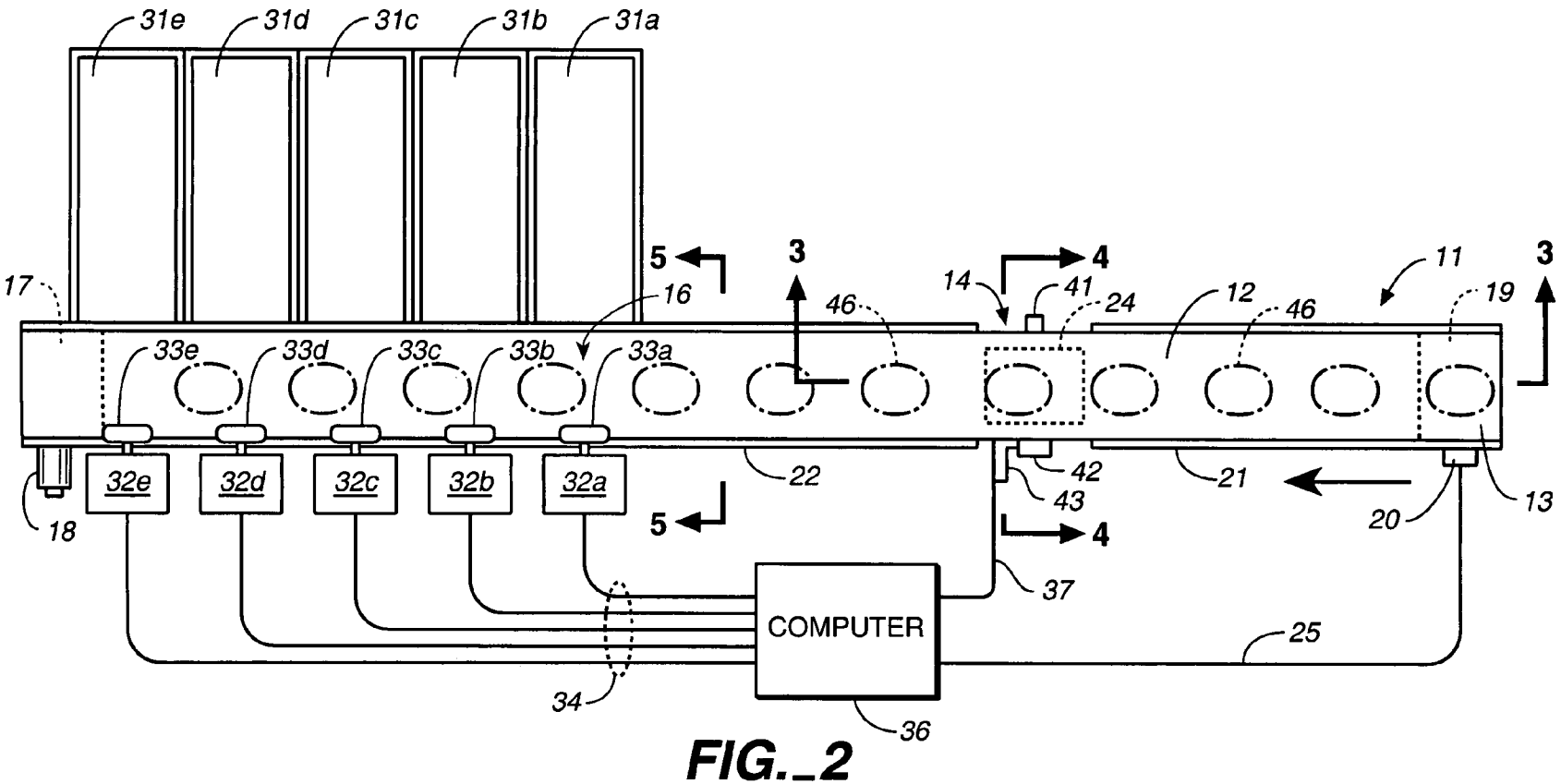
FIG. 2 is a plan view of the invention as shown in FIG. 1.

Referring to FIGS. 1 and 2, the weighing, counting and sorting system 11 of the present invention includes a continuous single loop conveyor belt 12 that travels from a loading station 13 to a weigh station 14, to a discharge section 16, and back to the loading station 13.

A motor 18 (preferably electric) drives a drum 17 which frictionally engages the conveyor belt 12 and drives it at a constant speed. The belt turns on an idler drum 19 at the loading station 13. The conveyor belt 12 is supported along its length and width by slightly concave support beds 21 and 22 which extend in opposite directions from either end of a scale 24 at the weigh station 14. Watermelons placed at one of the designated loading areas 46 on the belt 12 are carried along by the moving belt 12. While it is not required that the objects be placed at uniform spacing on the belt 12, it is advantageous to do so. The loading area indicators 46 permit the watermelons to be evenly spaced on the belt without the necessity of making measurements or "guesstimates."

Figure 3:
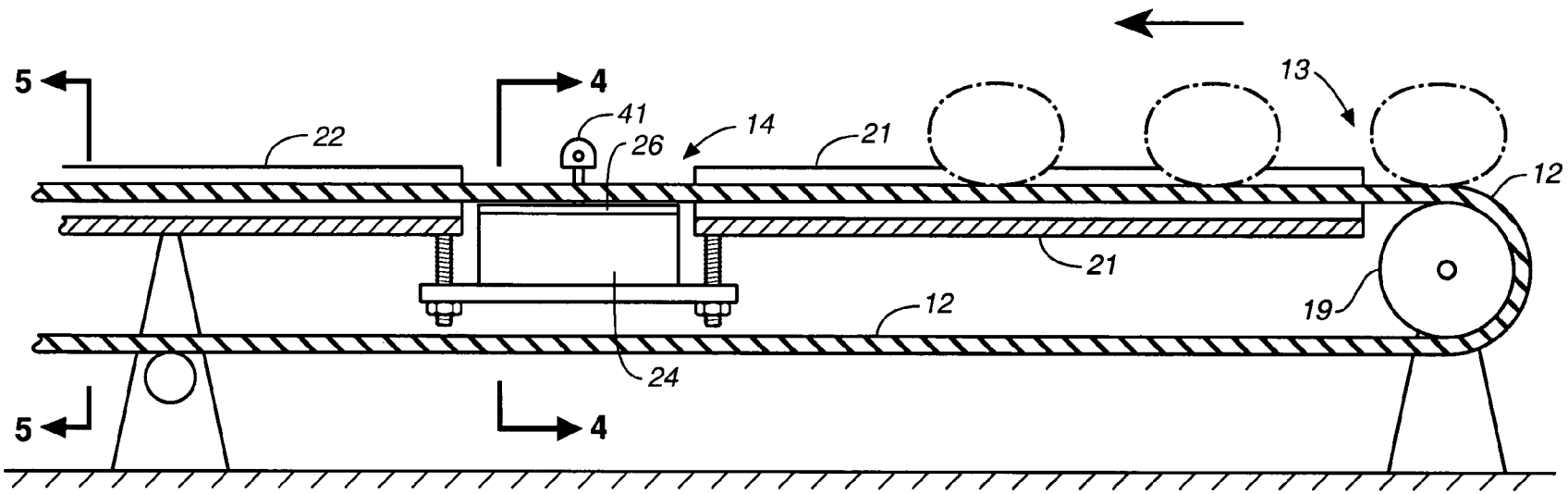
FIG. 3 is a section view taken along the line 3—3 of FIG. 2.

Referring to FIG. 3, at the weigh station 14, between support beds 21 and 22, the belt 12 travels over the top surface 26 of scale 24. A watermelon on the belt 12 over the scale 24 will push down on surface 26 and activate the scale.

Figure 4:
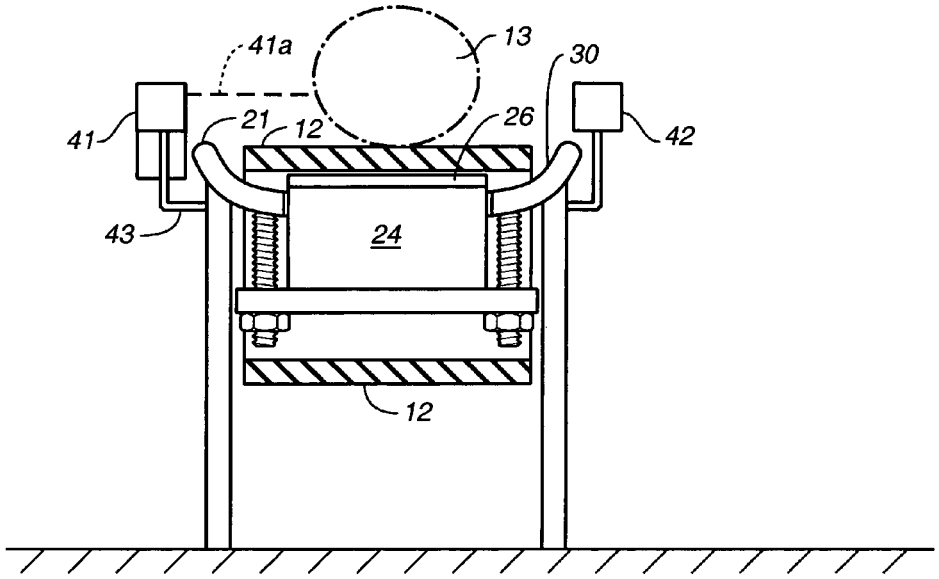
FIG. 4 is a section view taken along the line 4—4 of FIG. 2.
Figure 5:
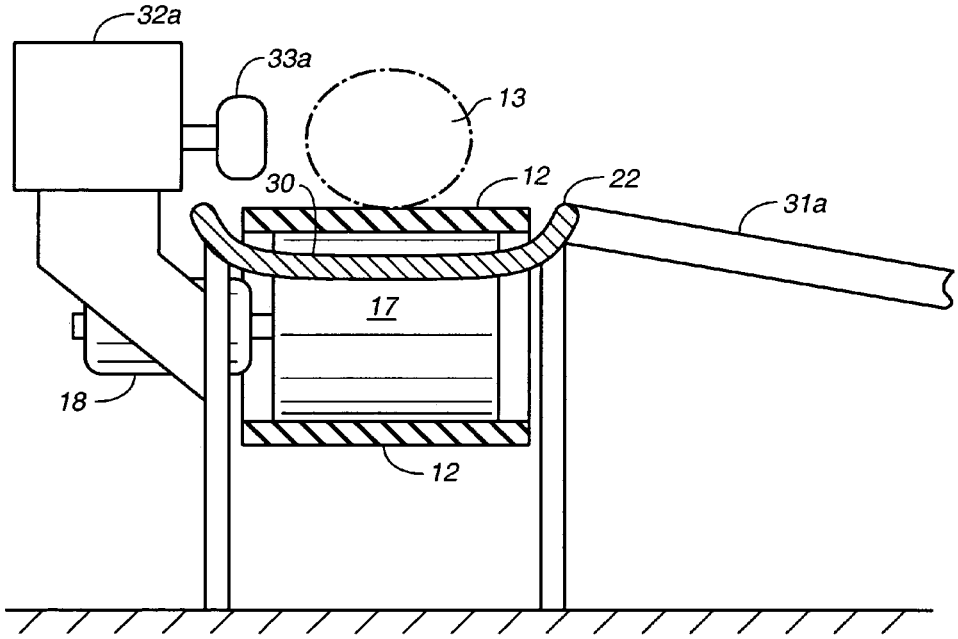
FIG. 5 is a section view taken along the line 5—5 of FIG. 2.
Figure 6:
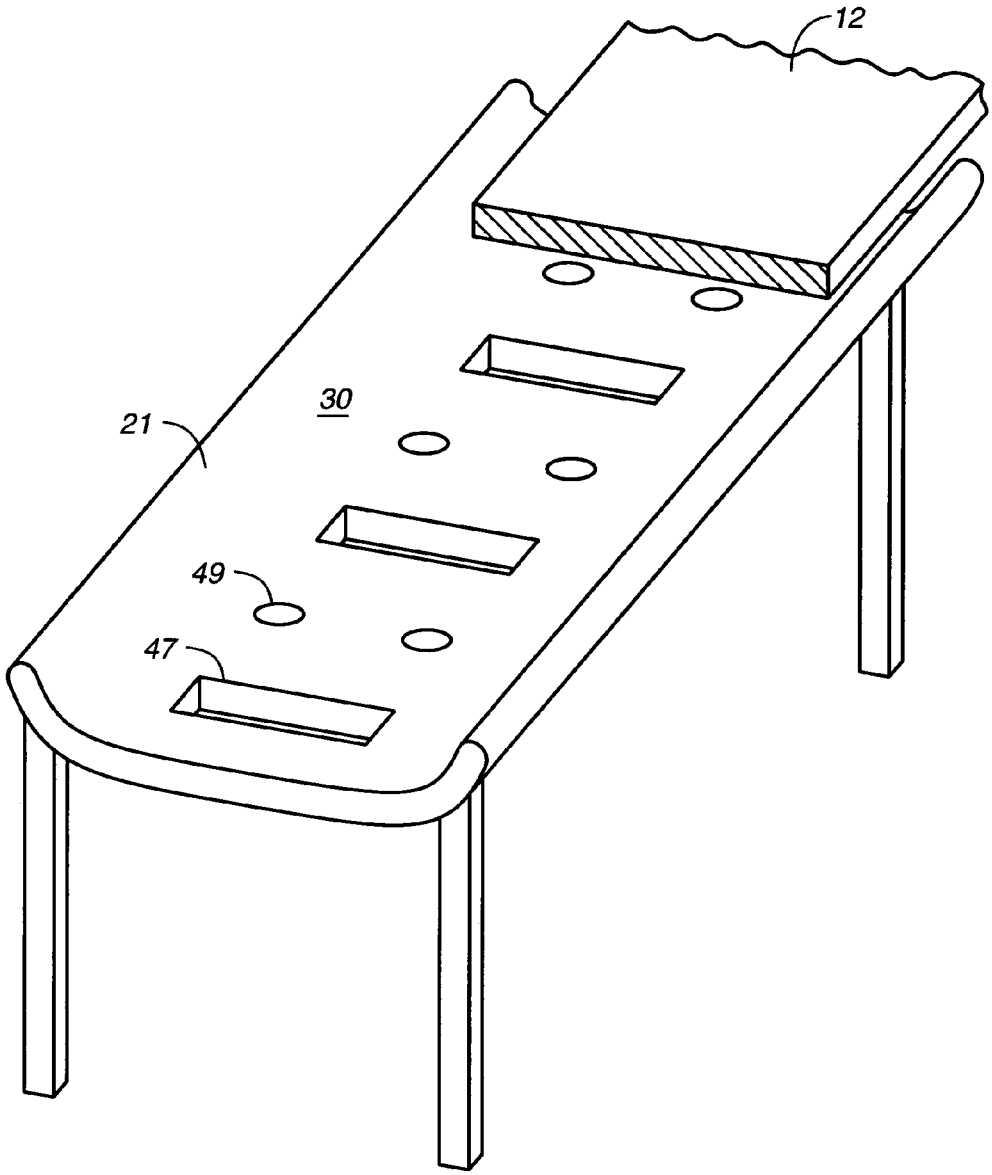
FIG. 6 is a schematic perspective view of the bed that underlies and supports the conveyor belt of the conveyor system of FIG. 1.

Referring to FIGS. 4, 5 and 6, one of the features of the invention is the physical relationship between the belt 12 and support beds 21 and 22. The beds 21 and 22 fully support the conveyor belt 12 across its width as it travels from the loading station 13 to the weigh station 14, and from the weigh station 14 to the discharge station 16. The support beds 21 and 22 can be formed from solid sheet metal or from sheets of material that have hole patterns to reduce their weight, as shown in FIG. 6. The beds 21 and 22 can also be constructed from separate attached members (not shown) so long as a bed is provided that supports the belt 12 along its width and length. In the preferred embodiment, the surface 30 over which the conveyor belt slides is slightly concave to prevent round objects, such as melons, from rolling off the conveyor belt.

Referring once again to FIGS. 1 and 2, the discharge station 16 includes a plurality of sorting bins 31*a*–31*e* adjacent the support bed 22 and conveyor belt 12. Each of the bins 31*a*–31*e* is capable of receiving and holding a plurality of watermelons.

As more fully explained below, an accurate scale weight for a watermelon may depend on the scale weight of the watermelon that was weighed before it and the scale weight of the watermelon that will be weighed after it. Thus, it may be necessary to weigh the next watermelon before the computer can determine into which bin the weighed watermelon belongs. This dictates that the distance between the weigh station 14 and the first bin 31*a* be at least the distance between designated loading areas 46 on the conveyor belt, and preferably double that distance or more (as shown).

For each bin 31*a*–31*e*, there is a corresponding watermelon pushing device 32*a*–32*e* on the opposite side of support bed 22 and belt 12. Each of the pushing devices 32*a*–32*e* includes a piston-driven pusharm 33*a*–33*e*, respectively, which, when actuated, extends partially across and above the belt 12, pushing any watermelon in its path into one of the opposing bins 31*a*–31*e*. Thus, a watermelon traveling on belt 12 will be directed into one of the bins 31*a*–31*e*, depending on which of the pusharms 33*a*–33*e* is actuated and contacts the watermelon.

Each of the pushing devices 32*a*–32*e* receives its actuating signals from a computer 36 (either by connecting wires 34 or wirelessly, as is well known in the art). The computer 36 receives weight data signals and count signals from the weigh station 14. The computer 36 also receives conveyor belt speed signals from roller 19 via transducer 20 and wire 25 (or wirelessly). These signals provide the computer with the data necessary to compute accurate weights for the watermelons and to compute and record the total number of watermelons weighed, the total number of watermelons weighed within a specified weight range, when a specified number of watermelons within a specified weight range have been weighed, how long it takes a watermelon to travel from the weigh station 14 to a bin 31*a*–31*e*, as well as other calculations and counts as required.

Referring to FIGS. 1, 2 and 3, a photocell 41 and a photodetector 42 provide the weigh station 14 with the ability to count watermelons, initiate transmission of weight data signals, and to track the location of a watermelon between the weigh station 14 and the discharge station 16 after it has been counted. The photocell 41 produces a beam of light 41*a* which is directed to the photodetector 42. When an object, such as a watermelon, on conveyor belt 12 breaks the light beam between photocell 41 and photodetector 42, a count signal is transmitted to computer 36 over lines 43 and 37 (or wirelessly, if preferred). It will be obvious to those skilled in the art that the function of the photocell 41 and photodetector 42 could be performed by electromechanical devices, as well.

In general, the invention operates as follows. The motor 18 is activated and drives the friction drive drum 17, which, in turn, drives the belt 12 so that the belt travels from the load station 13 toward the discharge station 16 at a constant speed made known to the computer 36 by transducer 20. Watermelons are loaded at station 13 onto belt 12 at designated loading areas 46 and carried to weigh station 14 where they are weighed. The scale 24 generates a weight data signal which is transmitted to computer 36. The photocell 41 and photodetector 42 are positioned adjacent the scale 24 so that when the light beam 41*a* is broken by a watermelon, the watermelon will activate the scale 24 which, in turn, will generate a weight data signal. The interrupted light beam 41*a* causes the weight data signal generated by the scale 24 to be transmitted to computer 36 where it is recorded. As more fully explained below, the scale weight of the watermelon is corrected to produce a "corrected" weight which the computer uses to determine into which of bins 31*a*–31*e* the watermelon will be directed. Once the computer has determined the correct weight, it knows in which of bins 31*a*–31*e* the watermelon belongs. By knowing the time that it will take for the watermelon to travel to a location adjacent the determined bin, the computer sends a signal to the pushing device at that location when the watermelon arrives, activating the associated pusharm, causing the watermelon to be directed into the correct bin.

Prior to commencing operations, each bin 31*a*–31*e* is assigned a weight range and the computer programmed to direct watermelons into the correct bins as described above. A look-up table can be programmed for each run by which watermelons of designated weights are directed to selected bins 31*a*–31*e*.

The watermelons are carried by the belt 12 to the weigh station 14, where the weight of the watermelon causes the belt and the watermelon to rest on the top surface 26 of the scale 24, where the weight of the watermelon is translated into a digital weight data signal (although an analog signal could work, as well), which is transmitted to the computer 36.

In addition to initiating recordation of the scale weight of the watermelon in the computer 36, the interruption of the light beam 41*a* also starts a countdown clock in the computer 36 for the particular watermelon which caused the light beam 41*a* to be broken. Because the conveyor belt 12 moves at a constant speed known to the computer 36, the computer 36 can calculate how long it will take the watermelon to travel from the photodetector 42 to any one of the watermelon pushing devices 32*a*–32*e*. By sending a signal to one of the pushing devices at the time when the watermelon will be adjacent that device, the computer can cause the watermelon to go into any of bins 31*a*–31*e*.

Because the watermelons do not leave the conveyor belt 12 when being weighed, the weight recorded by the scale can be more than the actual weight of the watermelon by an amount dependant on the weight of an adjacent preceding or an adjacent succeeding watermelon (or both) on the conveyor belt 12, if the adjacent watermelon is within approximately 36 inches of the watermelon being weighed. These adjacent watermelons assert a downward force on the scale through the belt 12, even when not directly over the scale 24. If the adjacent watermelon is more than approximately 36 inches away from the scale, this downward force is negligible and can be ignored. In the preferred embodiment, the spacing between designated loading areas 46 is less than 36 inches and, thus, the weight of watermelons at adjacent designated loading areas 46 must be taken into account. The correct weight of a watermelon is calculated by the computer after the computer receives a scale weight data signal for the watermelon being weighed, the watermelon (if any) at the preceding designated loading area 46, and the watermelon (if any) at the succeeding designated loading area 46. The calculation made by the computer factors in the characteristics of the conveyor belt 12 and the distance between designated watermelon locations 46 on the conveyor belt. Those skilled in the art will know how to program the computer to compute a corrected weight, taking into account the influencing factors mentioned above. One approach is to use empirical data to derive a correction factor as a function of weight and distance and use that data to create a look-up table.

Once a corrected weight is calculated for a watermelon, the computer can determine into which of the bins 31*a*–31*e* the watermelon should be directed. The distance between the weigh station 14 and the first pushing device 32*a* must be greater than the distance between designated loading spaces 46 to permit the succeeding watermelon to be weighed in order for the corrected weight of a watermelon to be determined before the watermelon arrives adjacent bin 31*a*. In this way, if the watermelon's corrected weight is within the range of weights assigned to bin 31*a*, the pushing device 32*a* can be activated by the computer in time to push the watermelon into bin 31*a*.

In those instances where there is no watermelon on the conveyor belt 12 within 36 inches of the watermelon being weighed, the scale weight will be the corrected weight.

In addition to controlling the sorting of watermelons by weight into various bins, the computer also keeps track of the number of watermelons weighed (by the number of times the light beam 41*a* is broken), the number of watermelons weighed for each defined weight category, and the total weight of watermelons weighed, as well as the total weight of watermelons weighed for each weight category. This data is very useful in the sorting process.

In order for the process to be reliable and accurate, and not be subject to human errors in counting, those responsible for loading the watermelons onto the conveyor belt 12 and unloading the watermelons into boxes (not shown) from the bins 31*a*–31*e* must be relieved of the responsibility of counting watermelons.

A typical function to be performed by the invention is to provide a customer with a given count of watermelons within a given size (weight range), but with a minimum overall weight. For example, a customer might order boxes of 50 watermelons with each watermelon having a weight not less than 14 pounds and not more than 16 pounds, and with each box having a minimum of 750 pounds of watermelons.

The present invention accomplishes this task without any human counting or calculations. The computer is programmed to deliver, as described above, to bins 31*c* and 31*d* watermelons within the selected weight range. It is further programmed to deliver the first 50 watermelons within the weight range to bin 31*c*; the next 50 watermelons within the weight range to bin 31*d*; the next 50 back to 31*c*; and so on. If, however, after counting 50 watermelons to bin 31*c*, for example, the total weight of those 50 watermelons is below 750 pounds, the computer continues to direct watermelons to bin 31*c* until 750 pounds is reached (this will usually involve one or two watermelons at the most). When the watermelons start being directed to bin 31*d*, the person unloading the watermelons from bin 31*c* knows that the box is complete and a new box needs to be started. The unloader does not have to count the watermelons and does not have to calculate weights.

Watermelons outside a customer's designated weight range can all be delivered to one or more of the other bins and/or sorted by weight within different weight ranges.

Because a purchaser can reject watermelons that do not meet its weight and count criteria, it is essential that the count and weight be accurate. By using the methods, machinery and weight correction factor described above, rejections of deliveries are avoided.

In the specialized situation where there is a single weight range, only one collection bin is to be used and all other objects are to be collected together, the invention can operate with a single pushing device 32*a*. All objects within the weight range are directed to bin 31*a*, and all other objects are allowed to travel to and fall off the end of the conveyor belt where a collection bin can be located.

Other protocols for using the weight and count data collected by the computer to perform specific tasks will occur to those skilled in the art.

Of course, various changes, modifications and alterations in the teachings of the present invention may be contemplated by those skilled in the art without departing from the intended spirit and scope thereof. As such, it is intended that the present invention only be limited by the terms of the appended claims.

What is claimed is:

1. A process for sorting watermelons by weight, comprising:

placing watermelons at spaced-apart locations on a conveyor belt at a loading station wherein the conveyor belt extends continuously from the loading station to a discharge station and over a scale therebetween;

moving the conveyor belt so that watermelons move successively from the loading station over the scale and to the discharge station whereby only one watermelon at a time is over the scale;

obtaining a scale weight measurement for each watermelon when it is over the scale on the conveyor belt wherein said scale weight measurement is a combination of downward forces on the conveyor belt produced by the weight of the watermelon over the scale and the weight of adjacent watermelons on the same conveyor belt but not over the scale;

computing a weight correction factor for each weighed watermelon using the scale weight measurement of that watermelon and the scale weight measurement of at least one other watermelon adjacent the watermelon being weighed;

sorting the watermelons at the discharge station according to a combination of their scale weight measurement and their weight correction factor.

2. The process steps of claim 1 wherein the number of other adjacent watermelon scale weight measurements used in computing a weight correction factor is two.

3. The process steps of claim 1, further comprising:

obtaining a corrected weight measurement for each watermelon using the weight correction factor for that watermelon.

4. The process steps of claim 1, further comprising:

directing a weight data signal of the scale measurement of each watermelon to a computer;

computing a corrected weight measurement for each weighed watermelon using the weight correction factor for that watermelon, and the scale weight measurement for that watermelon.

5. The process steps of claim 4 wherein the discharge station has a plurality of collecting bins and the step of sorting the watermelons includes:

mechanically pushing the watermelons off of the conveyor belt into a collecting bin.

6. The process steps of claim 5 wherein the step of pushing a watermelon off of the conveyor belt and into a collecting bin is performed by a mechanical pusharm that is disposed above and adjacent the conveyor belt.

7. The process steps of claim 6 wherein there is a separate mechanical pusharm associated with each collecting bin.

8. The process of step 7 wherein the mechanical pusharms are activated by activating signals from the computer.

9. The process steps of claim 8 wherein the computer directs an activating signal to a particular pusharm at a time based on the corrected weight measurement of a watermelon, the speed of the conveyor belt and the distance between the scale and the pusharm.

10. A process for sorting objects by weight, comprising:

placing objects at spaced-apart locations on a conveyor belt at a loading station wherein the conveyor belt extends continuously from the loading station to a discharge station and over a scale therebetween;

moving the conveyor belt so that objects move successively from the loading station over the scale and to the discharge station whereby only one object at a time is over the scale;

obtaining a scale weight measurement for each object when it is over the scale on the conveyor belt wherein said scale weight measurement is a combination of downward forces on the conveyor belt produced by the weight of the object over the scale and the weight of other adjacent objects on the same conveyor belt but not over the scale;

computing a weight correction factor for each weighed object using the scale weight measurement of that object and the scale weight measurement of at least one other object adjacent the object being weighed; and sorting the objects at the discharge station according to a combination of their scale weight measurement and their weight correction factor.

11. The process steps of claim 10 wherein the number of other adjacent object scale weight measurements used in computing a weight correction factor is two.

12. The process of claim 10, further comprising:

obtaining a corrected weight measurement for each object weighed using the weight correction factor for that object.

13. The process steps of claim 12, wherein the discharge station includes a plurality of collecting bins and the sorting step comprises:

transporting each object to one of the collecting bins based on the corrected weight measurement for each object.

14. The process steps of claim 13 wherein the step of transporting the objects to a collecting bin includes:

mechanically pushing the objects off of the conveyor belt and into a collecting bin.

15. The process steps of claim 14 wherein the step of pushing an object off of the conveyor belt and into a collecting bin is performed by a mechanical pusharm that is disposed above and adjacent the conveyor belt.

16. The process steps of claim 15 wherein there is a separate mechanical pusharm associated with each collecting bin.

17. The process of step 16 wherein the mechanical pusharms are activated by activating signals from the computer.

18. The process steps of claim 16 wherein the computer directs an activating signal to a particular pusharm at a time based on the corrected weight measurement of an object, the speed of the conveyor belt and the distance between the weigh station and the pusharm.

19. The process steps of claim 10, further comprising:

directing a weight data signal of the scale weight measurement of each object to a computer;

computing a corrected weight measurement for each object using the weight correction factor for that object and the scale weight measurement for that object.

* * * * *